US012270297B2

(12) United States Patent
Liang et al.

(10) Patent No.: US 12,270,297 B2
(45) Date of Patent: Apr. 8, 2025

(54) METHOD FOR DETECTING BOREHOLE CAVING BASED ON CUTTINGS AND ELEMENTS LOGGING DATA

(71) Applicant: Southwest Petroleum University, Sichuan (CN)

(72) Inventors: Haibo Liang, Chengdu (CN); Hai Yang, Chengdu (CN); Zhongbing Li, Chengdu (CN); Pengbo Ni, Tianjin (CN); Jialing Zou, Chengdu (CN); Yi Zhang, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 340 days.

(21) Appl. No.: 17/881,648

(22) Filed: Aug. 5, 2022

(65) Prior Publication Data

US 2024/0044247 A1 Feb. 8, 2024

(51) Int. Cl.
*E21B 49/00* (2006.01)

(52) U.S. Cl.
CPC ..... *E21B 49/005* (2013.01); *E21B 2200/20* (2020.05); *E21B 2200/22* (2020.05)

(58) Field of Classification Search
None
See application file for complete search history.

(56) References Cited

U.S. PATENT DOCUMENTS

2014/0214325 A1* 7/2014 Wessling ..... E21B 47/06 702/11

FOREIGN PATENT DOCUMENTS

WO WO-2015191095 A1 * 12/2015 ..... E21B 21/08

* cited by examiner

*Primary Examiner* — Matthew G Marini

(57) ABSTRACT

A method for detecting a borehole caving based on cuttings and elements logging data includes: integrating real-time elements logging data and real-time cuttings return data of a target well, and historical elements logging data and stratum evaluation data of an adjacent well; calculating a root mean square deviation (RMSD) Δ of a relative content of each element of the target well and the adjacent well and a real-time cuttings return ratio; setting a threshold λ of the RMSD Δ of the relative content of each element and a threshold range (a,b) of the real-time cuttings return ratio; and establishing an intelligent stratum identification model based on a support vector machine (SVM) for real-time determination of a horizon from which current cuttings are returned. The method can achieve effective borehole caving detection, such that on-site personnel can deal with borehole caving in time and prevent it from developing into a complicated drilling accident.

4 Claims, 2 Drawing Sheets

METHOD FOR DETECTING BOREHOLE CAVING BASED ON CUTTINGS AND ELEMENTS LOGGING DATA

TECHNICAL FIELD

The present disclosure belongs to the technical field of drilling engineering and, in particular, relates to a method for detecting a borehole caving based on cuttings and elements logging data.

BACKGROUND

During drilling construction, borehole cavings will lead to various problems, such as the change of the wellbore diameter and stratum breakdown. In more severe cases, borehole cavings will cause more complicated accidents, such as complete failure of the wellbore and jamming or dropping of the drilling tool. In addition, borehole cavings will also cause serious pollution to the reservoir, increasing the difficulty of resource exploration and affecting production efficiency. In the most severe cases, borehole cavings will lead to the direct abandonment of the wellbore. Therefore, the detection of borehole caving is a worldwide technical problem in drilling engineering, and it is also one of the core problems of safe and efficient drilling. At present, borehole caving detection often relies on the long-term work experience of field engineers. The empirical detection method is inefficient and inaccurate and cannot quickly and accurately detect borehole cavings while drilling is taking place in stratums with different lithologies.

SUMMARY

To overcome the above-mentioned deficiencies in the prior art, an objective of the present disclosure is to provide a method for detecting a borehole caving based on cuttings and elements logging data. The present disclosure acquires elements logging data and cuttings return data of a target well in real-time, establishes an intelligent stratum identification model based on a support vector machine (SVM) for real-time stratum identification, and performs borehole caving detection based on historical elements logging data and stratum evaluation data of an adjacent well. The present disclosure can provide important guidance for on-site construction, effectively avoid complicated drilling accidents, and improve drilling operation efficiency.

The present disclosure adopts the following technical solution:

A method for detecting a borehole caving based on cuttings and elements logging data includes the following steps:

step 1: acquiring historical elements logging data and stratum evaluation data of an adjacent well and real-time elements logging data and real-time cuttings return data of a target well;

step 2: calculating a root mean square deviation (RMSD) Δ of a relative content of an element in the target well and a relative content of a corresponding element of the adjacent well; and weighing and calculating a real-time cuttings return volume $V_{real\text{-}time}$ and a theoretical cuttings return volume $V_{theoretical}$;

step 3: establishing an intelligent stratum identification model based on an SVM, training the intelligent stratum identification model through the historical elements logging data of the adjacent well, importing the real-time elements logging data into the intelligent stratum identification model for real-time stratum identification, and calculating a real-time cuttings return ratio $R_{return}$ based on the data calculated in step 2;

step 4: comparing a real-time stratum identification result of the target well with stratum of the adjacent well and selecting a parameter for borehole caving detection in a same horizon;

step 5: setting a threshold λ of the RMSD of the relative content of each element and a threshold range (a,b) of the real-time cuttings return ratio; and step 6: performing borehole caving detection based on the real-time stratum identification result acquired in step 3 in combination with the threshold λ of the RMSD of the relative content of each element and the threshold range (a,b) of the real-time cuttings return ratio set in step 5.

In a further technical solution, in step 1, the real-time elements logging data may include data of sodium (Na), magnesium (Mg), aluminum (Al), silicon (Si), phosphorus (P), sulfur (S), manganese (Mn), potassium (K), and calcium (Ca).

In a further technical solution, in step 1, the stratum evaluation data of the adjacent well may include stratum lithology.

In a further technical solution, in step 3, the intelligent stratum identification model may be established by:

(1) constructing an input set including the relative content of each element, namely $P=[P_1, P_2, \ldots P_n]$;

(2) determining a penalty coefficient C, a kernel function K and a kernel parameter in an SVM model;

(3) training the SVM model by the historical elements logging data and stratum evaluation data of the adjacent well and saving;

(4) importing the real-time elements logging data into the trained SVM model for real-time stratum identification.

In a further technical solution, in step 2, the RMSD Δ may be expressed by:

$$\Delta = \sqrt{\frac{\sum_{i=0}^{n}\left(p_{ireal-time} - p_{ihistorical}\right)^2}{n}}$$

The real-time cuttings return ratio may be calculated by:

$$R_{return} = \frac{V_{real-time}}{V_{theoretical}}.$$

In a further technical solution, in step 6, the borehole caving detection may specifically include:

(1) comparing the real-time stratum identification result of the target well with a stratum identification result of the adjacent well and determining whether a horizon of a current drilling section is changed; and not incorporating the RMSD Δ of the relative content of each element as an evaluation parameter for subsequent borehole caving evaluation if the horizon of the current drilling section is changed; and (2) comparing the RMSD Δ of the relative content of each element and the real-time cuttings return ratio $R_{return}$ with respective thresholds; and determining that a borehole caving occurs and drilling is necessarily stopped immediately if the following conditions are met:

$$\begin{cases} \Delta > \lambda \\ R_{return} > b \end{cases}.$$

The present disclosure has the following beneficial effects:

1. The present disclosure integrates the real-time elements logging data, the real-time cuttings return data, the theoretical cuttings return data, the elements logging data of the adjacent well, and stratum evaluation data of the adjacent well, which are reliable and timely. The present disclosure establishes the SVM-based stratum identification model, which improves the detection accuracy of borehole caving, and reduces labor intensity.
2. The present disclosure can provide real-time detection results during on-site construction to provide guidance to on-site engineers to avoid complicated drilling accidents, improve drilling construction efficiency, and save costs.

DETAILED DESCRIPTION OF THE EMBODIMENTS

In order to make the objectives, technical solutions, and advantages of the embodiments of the present disclosure clearer, the technical solutions in the present disclosure are described clearly and completely below. The described embodiments are some, rather than all, of the embodiments of the present disclosure. All other embodiments obtained by those of ordinary skill in the art based on the embodiments of the present disclosure without creative efforts should fall within the protection scope of the present disclosure.

Figure 1:
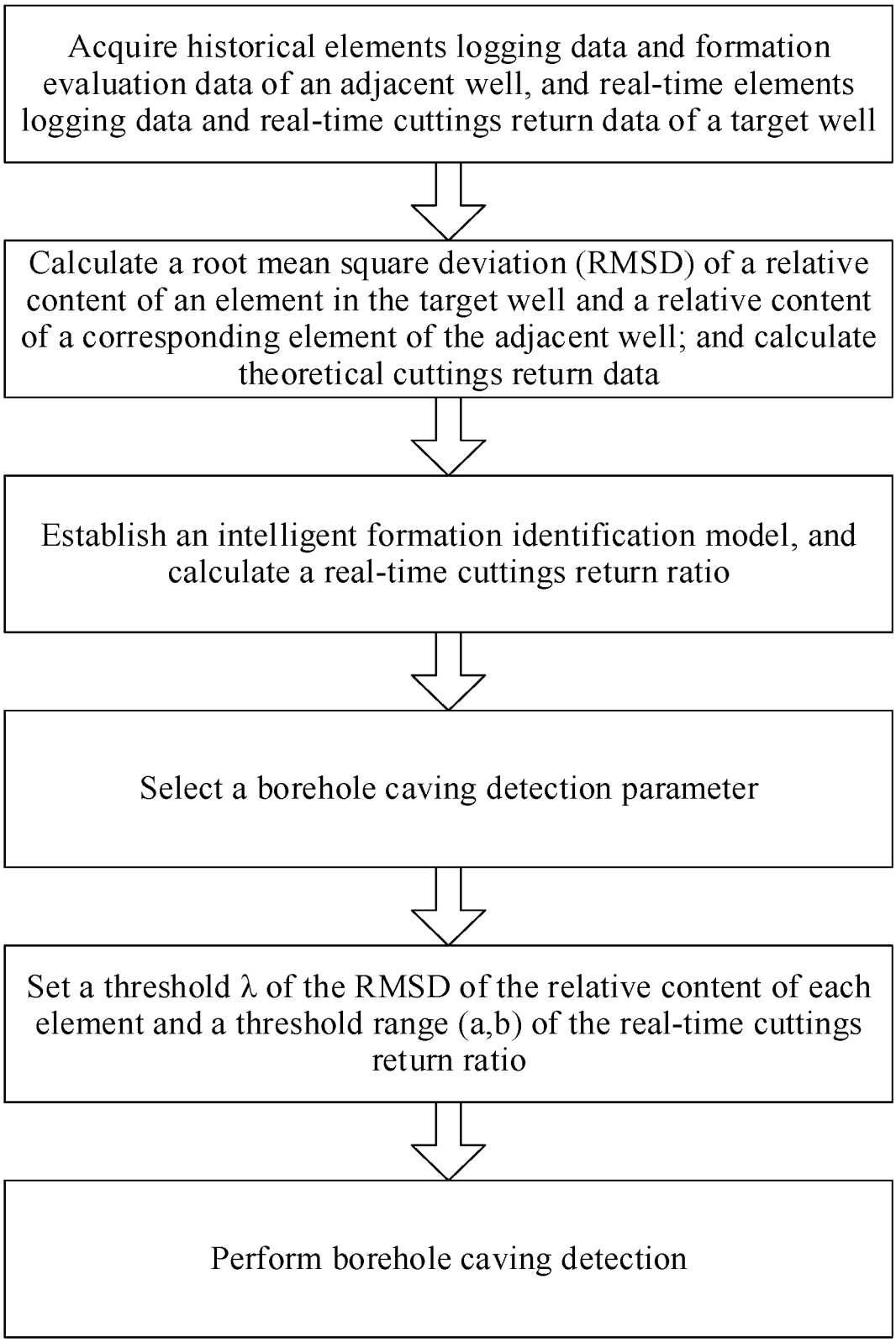
FIG. 1 is a flowchart of a method for detecting a borehole caving based on cuttings and elements logging data according to the present disclosure.

As shown in FIG. 1, the present disclosure provides a method for detecting a borehole caving based on cuttings and elements logging data. The present disclosure conducts a comprehensive evaluation of multi-source data, including real-time elements logging data, elements logging data of an adjacent well, stratum evaluation data of the adjacent well, a real-time cuttings return volume, a theoretical cuttings return volume, and a cuttings return ratio.

The method provided by the present disclosure specifically includes the following steps:

Step 1: Acquire historical elements logging data and stratum evaluation data of an adjacent well and real-time elements logging data and real-time cuttings return data of a target well.

Step 2: Calculate a root mean square deviation (RMSD) $\alpha$ of a relative content of an element in the target well and a relative content of a corresponding element of the adjacent well; and weighing and calculating a real-time cuttings return volume $V_{real\text{-}time}$ and a theoretical cuttings return volume $V_{theoretical}$.

Step 3: Establish an intelligent stratum identification model based on an SVM (FIG. 2), train the intelligent stratum identification model through the historical elements logging data of the adjacent well, import the real-time elements logging data into the intelligent stratum identification model for real-time stratum identification, and calculate a real-time cuttings return ratio $R_{return}$ based on the data calculated in step 2.

Step 4: Compare a real-time stratum identification result of the target well with stratum of the adjacent well and select a parameter for borehole caving detection in a same horizon.

Step 5: Set a threshold $\lambda$ of the RMSD of the relative content of each element and a threshold range (a,b) of the real-time cuttings return ratio.

Step 6: Perform borehole caving detection based on the real-time stratum identification result acquired in step 3 in combination with the threshold $\lambda$ of the RMSD of the relative content of each element and the threshold range (a,b) of the real-time cuttings return ratio set in step 5.

In a further solution, in step 1, the real-time elements logging data includes data of sodium (Na), magnesium (Mg), aluminum (Al), silicon (Si), phosphorus (P), sulfur (S), manganese (Mn), potassium (K), and calcium (Ca).

In a further solution, the stratum evaluation data of the adjacent well is stratum lithology.

The basic principles of the present disclosure are described in further detail below with reference to specific embodiments.

The method of the present disclosure was optimally performed when testing Well xxx-1 in the Weiyuan block. The method of the present disclosure acquired the elements logging data and the cuttings return data during drilling construction to perform real-time detection of borehole caving.

1. Data Processing (1) The historical elements logging data and stratum evaluation data of an adjacent well were acquired to establish a training set of an intelligent model. In the training set, the relative content of each element was denoted as $P_{historical}=[P_1, P_2, \ldots P_n]$, where $P_1, P_2, \ldots$, and $P_n$ denoted the relative contents of Na, Mg, Al, Si, P, S, Mn, K, and Ca of the adjacent well, respectively. In addition, the stratum lithology corresponding to each section of the adjacent well was also acquired.

The relative content of each element in a 5,400-5,401 m section of the adjacent well was calculated as:

$$P_{historical}=[1.995, 5.634, 18.507, 39.594, 0.207, 2.726, 0.068, 4.154, 4.272]$$

(2) The real-time elements logging data of the target well was acquired (by an analytical instrument) to establish an input set of the model, including the relative content of the elements, namely $P_{real\text{-}time}=[P_1, P_2, \ldots P_n]$, where $P_1, P_2, \ldots$, and $P_n$ denoted the relative contents of Na, Mg, Al, Si, P, S, Mn, K, and Ca of the target well, respectively.

The relative content of each element in the target well was calculated as:

$$P_{real\text{-}time}=[2.298, 6.262, 15.05, 68.005, 0.113, 2.661, 0.04, 2.889, 5.02]$$

The real-time cuttings return volume was calculated by:

$$V_{real\text{-}time}=m_{dry}/\rho_{cuttings}$$

$mm_{dry}$ denoted a dry weight, acquired by an on-site weighing system, of wet cuttings returned in real-time; and $\rho_{cuttings}$ denoted a cuttings density.

The total mass of the returned cuttings in the 5,400-5,401 m well section was $m_{dry}$=2.97.986 kg, and the measured cuttings density was $\rho_{cuttings}$=3.2 g/cm$^3$. Therefore, the volume of the cuttings returned from the current well section was $V_{real\text{-}time}$=231.47 kg/3.2 g/cm$^3$=93120.69 cm$^3$=0.09312 m$^3$.

The theoretical volume of the returned cuttings was calculated by:

$$V_{theoretical} = \frac{1}{4}\pi D_{drill\ bit}^2 h \Delta V_e$$

$D_{drill\ bit}$ denoted a diameter of a drill bit;

h denoted the length of the drilled well section; and $\Delta V_e$ denoted a borehole enlargement rate.

The diameter of the drill bit used for this well section was 311.15 mm, the length of the drilled well section was 1 m, and the borehole enlargement rate was 102%. Therefore, the theoretical cuttings return ratio was $V_{theoretical}$=0.0776 m$^3$.

2. Establishment of the Intelligent Stratum Identification Model (1) A penalty coefficient C, a kernel function K, and a kernel parameter in an SVM model were determined.

The kernel function K is a Gauss radial basis kernel function. The present disclosure dealt with nonlinear classification, so the present disclosure employed a radial basis kernel function that is easy to implement. The kernel function can be used for samples with any distribution and is especially suitable for the case of a few samples or lack of empirical distribution. Meanwhile, in this kernel function, fewer kernel parameters need to be calculated.

$$K(x, x_i) = \exp\left(-\frac{\|x - x_i\|^2}{\sigma^2}\right)$$

The penalty factor C and the kernel parameter σ are generally determined by experience. A larger C indicates more importance attaches to the sample and indicates that it is more likely to overfit. Conversely, a smaller C indicates less importance attaches to the sample and indicates that it is more likely to underfit. A larger σ indicates coarser classification and indicates that it is more likely to underfit. Conversely, a smaller σ indicates finer classification and indicates that it is more likely to overfit. Therefore, to achieve the best classification effect of the model, C takes the value of 16, and σ takes the value of 5.6569.

Figure 2:
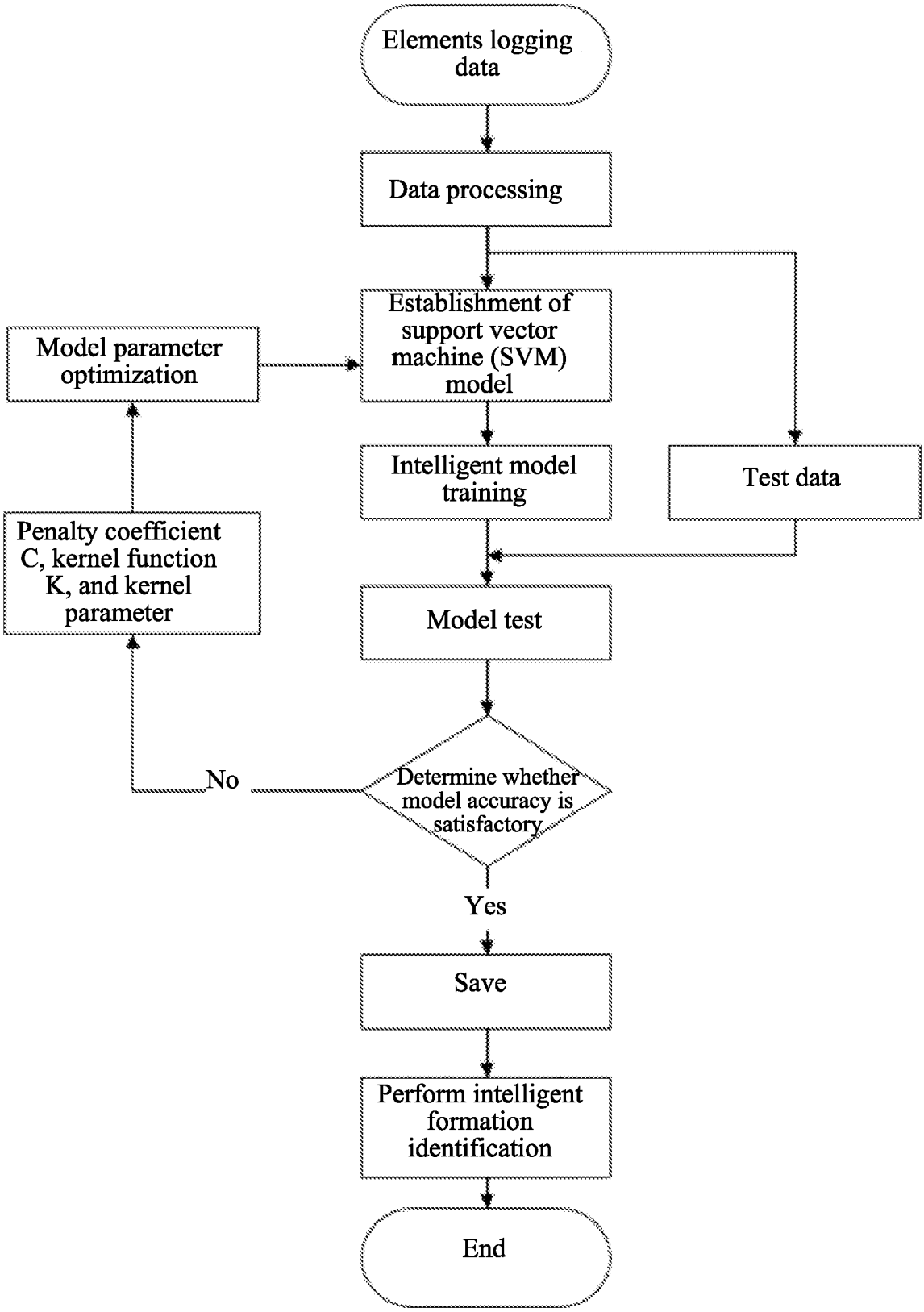
FIG. 2 is a flowchart of support vector machine (SVM)-based intelligent stratum identification according to the present disclosure.

(2) FIG. 2 shows a training process for intelligent stratum identification. The SVM model was trained through historical elements data $P_{historical}$ and stratum evaluation data of the adjacent well and was then saved.

3. The real-time elements logging data $P_{historical}$ was imported into the trained model for real-time stratum identification (the stratum identification result might be clastic debris, carbonate rock, mud shale, limestone, or dolomite). The RMSD Δ of the relative content of an element in the target well and the relative content of the corresponding element of the adjacent well was calculated.

$$\Delta = \sqrt{\frac{\sum_{i=0}^{n}\left(p_{ireal-time} - p_{ihistorical}\right)^2}{n}} = 9.55$$

The real-time cuttings return ratio was calculated by:

$$\frac{V_{real-time}}{V_{theoretical}} = \frac{0.0931}{0.0776} \times 100\% = 119.97\%.$$

4. The threshold of the RMSD of the relative content of the element was set as λ=2.5, and the threshold of the real-time cuttings return ratio was set as (a=0.82, b=1.15).

5. Borehole caving detection was performed based on the RMSD Δ of the relative content of each element, the real-time cuttings return ratio $R_{return}$, the stratum identification result acquired in step 3 in combination with the threshold λ of the RMSD of the relative content of each element and the threshold range (a,b) of the real-time cuttings return ratio set in step 4.

(1) The real-time stratum identification result (shale) of the target well was compared with the stratum identification result (shale) of the adjacent well, showing that the stratum properties of the current drilling section were not changed significantly. Therefore, the RMSD Δ of the relative content of the elements could be incorporated as an evaluation parameter in the subsequent determination of borehole caving.

(2) The RMSD Δ of the relative content of the elements and the real-time cuttings return ratio $R_{return}$ were compared with respective thresholds. It was determined that a borehole caving occurred and might be developed into a borehole collapse accident, indicating that drilling should be stopped immediately if the following conditions were met:

$$\begin{cases} 9.55 > 2.55 \\ 1.1997 > 1.15 \end{cases}.$$

Finally, it should be noted that the above embodiments are only intended to illustrate the technical solutions of the present disclosure, rather than to limit the present disclosure. Although the present disclosure is described in detail with reference to the above embodiments, those of ordinary skill in the art should understand that they can still modify the technical solutions described in the above embodiments or make equivalent substitutions to some technical features therein. However, these modifications or substitutions should not make the essence of the corresponding technical solutions depart from the spirit and scope of the technical solutions in the embodiments of the present disclosure.

What is claimed is:

1. A method for detecting a borehole caving based on cuttings and elements logging data comprising the following steps:

step 1: acquiring historical elements logging data and stratum evaluation data of an adjacent well and real-time elements logging data and real-time cuttings return data of a target well;

step 2: calculating a root mean square deviation (RMSD) A of a relative content of an element in the target well and a relative content of a corresponding element of the adjacent well; and weighing and calculating a real-time cuttings return volume $V_{real\text{-}time}$ and a theoretical cuttings return volume $V_{theoretical}$;

step 3: establishing an intelligent stratum identification model based on a support vector machine (SVM), training the intelligent stratum identification model through the historical elements logging data of the adjacent well, importing the real-time elements logging data into the intelligent stratum identification model for real-time stratum identification, and calculating a real-time cuttings return ratio $R_{return}$ based on the data calculated in step 2:

$$R_{return} = \frac{V_{real-time}}{V_{theoretical}};$$

step 4: comparing a real-time stratum identification result of the target well with stratum of the adjacent well and selecting a parameter for borehole caving detection in a same horizon;

step 5: setting a threshold λ of the RMSD of the relative content of each element and a threshold range (a,b) of the real-time cuttings return ratio; and step 6: performing borehole caving detection based on the real-time stratum identification result acquired in step 3 in combination with the threshold λ of the RMSD of the relative content of each element and the threshold range (a,b) of the real-time cuttings return ratio set in step 5, wherein in step 6, the borehole caving detection specifically comprises:

(1) comparing the real-time stratum identification result of the target well with a stratum identification result of the adjacent well; when the real-time stratum identification result of the target well is consistent with the stratum identification result of the adjacent well, according to the borehole caving detection of a current horizon of the target well, determining the RMSD Δ of the relative content of each element of the horizon as an evaluation parameter;

(2) comparing the RMSD Δ of the relative content of each element and the real-time cuttings return ratio $R_{return}$ with respective thresholds; and determining that a borehole caving occurs and drilling is necessarily stopped immediately when the following conditions are met:

$$\begin{cases} \Delta > \lambda \\ R_{return} > b \end{cases};$$

determining that a borehole wall is in good condition, no borehole caving occurs, and drilling is allowed to continue when the following conditions are met:

$$\begin{cases} \Delta < \lambda \\ a < R_{return} < b \end{cases}.$$

2. The method according to claim 1, wherein in step 1, the real-time elements logging data comprises data of sodium (Na), magnesium (Mg), aluminum (Al), silicon (Si), phosphorus (P), sulfur(S), manganese (Mn), potassium (K), and calcium (Ca); and the stratum evaluation data of the adjacent well comprises stratum lithology.

3. The method according to claim 1, wherein in step 2, the RMSD Δ is expressed by:

$$\Delta = \sqrt{\frac{\sum_{i=0}^{n} (p_{ireal-time} - p_{ihistorical})^2}{n}}$$

$P_{i,real-time}$ denotes a real-time relative content of each element in the target well;

$P_{i,historical}$ denotes a relative content of each element in the adjacent well; and n denotes a total count of elements.

4. The method according to claim 1, wherein in step 3, the intelligent stratum identification model is established by:

(1) constructing an input set comprising the relative content of each element, namely $P=[P_1, P_2, \ldots P_n]$, wherein $P_1, P_2, \ldots$, and $P_n$ denote the relative contents of Na, Mg, Al, Si, P, S, Mn, K, and Ca, respectively;

(2) determining a penalty coefficient C, a kernel function K, and a kernel parameter in an SVM model;

(3) training the SVM model by the historical elements logging data and stratum evaluation data of the adjacent well to obtain a trained SVM model and saving the trained SVM model;

(4) importing the real-time elements logging data into the trained SVM model for real-time stratum identification.

* * * * *